US007602922B2

(12) United States Patent
Breebaart et al.

(10) Patent No.: US 7,602,922 B2
(45) Date of Patent: Oct. 13, 2009

(54) MULTI-CHANNEL ENCODER

(75) Inventors: Dirk J. Breebaart, Eindhoven (NL); Erik G. P. Schuijers, Eindhoven (NL); Gerard H. Hotho, Eindhoven (NL); Machiel W. Van Loon, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 384 days.

(21) Appl. No.: 10/599,559

(22) PCT Filed: Mar. 25, 2005

(86) PCT No.: PCT/IB2005/051037

§ 371 (c)(1),
(2), (4) Date: Oct. 2, 2006

(87) PCT Pub. No.: WO2005/098821

PCT Pub. Date: Oct. 20, 2005

(65) Prior Publication Data

US 2007/0194952 A1 Aug. 23, 2007

(30) Foreign Application Priority Data

Apr. 5, 2004 (EP) ..... 04101405
Jun. 22, 2004 (EP) ..... 04102863

(51) Int. Cl.
*H04R 5/00* (2006.01)

(52) U.S. Cl. ..... 381/23; 381/19; 381/21; 381/22; 704/500; 704/501; 704/203

(58) Field of Classification Search ..... 381/1, 381/19–23, 63; 704/500–501, 207, 200.1, 704/205, 224, 203, 503
See application file for complete search history.

(56) References Cited

U.S. PATENT DOCUMENTS 5,857,026 A * 1/1999 Scheiber ..... 381/23
5,982,903 A * 11/1999 Kinoshita et al. ..... 381/18

(Continued)

FOREIGN PATENT DOCUMENTS

WO WO2004008805 A1 1/2004
WO WO2005069274 A1 7/2005

OTHER PUBLICATIONS

Faller et al: "Binaural Cue Coding: A Novel and Efficient Representation of Spatial Audio"; Audio Engineering Society Convention Paper, New York, NY, May 10, 2002, pp. 1841-1844, XP001153972.

(Continued)

*Primary Examiner*—Vivian Chin
*Assistant Examiner*—Disler Paul

(57) ABSTRACT

There is described a multi-channel encoder (10; 600) for processing input signals conveyed in N input channels to generate corresponding output signals conveyed in M output channels together with complementary parametric data; M and N are integers wherein N>M. The encoder (10; 600) includes a down-mixer for down-mixing the input signals to generate the corresponding output signals, the encoder also comprising an analyser for processing the input signals to generate the parameter data, said parametric data describing mutual differences between the N channels of input signal to allow for regenerating during decoding one or more of the N channels of input signals from the M channels of output signal. Such an encoder (10; 600) is capable of providing highly efficient data encoding and also of being backwards compatibility with relatively simpler decoders having fewer than N decoding output channels. The invention also concerns decoders (800) compatible with such a multi-channel encoder (10; 600).

24 Claims, 3 Drawing Sheets

U.S. PATENT DOCUMENTS

| | | | | |
|---|---|---|---|---|
| 7,394,903 | B2 * | 7/2008 | Herre et al. | 381/23 |
| 7,447,317 | B2 * | 11/2008 | Herre et al. | 381/23 |
| 2004/0028244 | A1 * | 2/2004 | Tsushima et al. | 381/98 |
| 2005/0195981 | A1 * | 9/2005 | Faller et al. | 381/23 |
| 2008/0195397 | A1 * | 8/2008 | Myburg et al. | 704/500 |

OTHER PUBLICATIONS

Herre et al: "MP3 Surround: Efficient and Compatible Coding of Multi-Channel Audio"; AES 116th Convention, Audio Engineering Society, May 8, 2004, pp. 1-14, XP002340080.

* cited by examiner

MULTI-CHANNEL ENCODER

FIELD OF THE INVENTION

The present invention relates to multi-channel encoders, for example multi-channel audio encoders utilizing parametric descriptions of spatial audio. Moreover, the invention also relates to methods of processing signals, for example spatial audio signals, in such multi-channel encoders. Furthermore, the invention relates to decoders operable to decode signals generated by such multi-channel encoders.

BACKGROUND TO THE INVENTION

Audio recording and reproduction has in recent years progressed from monaural single-channel format to dual-channel stereo format and more recently to multi-channel format, for example five-channel audio format as often used in home movie systems. The introduction of super audio compact disk (SACD) and digital versatile disc (DVD) data carriers has resulted in such five-channel audio reproduction contemporarily gaining interest. Many users presently own equipment capable of providing five-channel audio playback in their homes; correspondingly, five-channel audio program content on suitable data carriers is becoming increasingly available, for example the aforementioned SACD and DVD types of data carriers. On account of growing interest in multi-channel program content, more efficient coding of multi-channel audio program content is becoming an important issue, for example to provide one or more of enhanced quality, longer playing time or even more channels.

Encoders capable of representing spatial audio information such as for audio program content by way of parametric descriptors are known. For example, in a published international PCT patent application no. PCT/IB2003/002858 (WO 2004/008805), encoding of a multi-channel audio signal including at least a first signal component (LF), a second signal component (LR) and a third signal component (RF) is described. This coding utilizes a method comprising steps of:

(a) encoding the first and second signal components by using a first parametric encoder for generating a first encoded signal (L) and a first set of encoding parameters (P2);

(b) encoding the first encoded signal (L) and a further signal (R) by using a second parametric encoder for generating a second encoded signal (T) and a second set of encoding parameters (P1) wherein the further signal (R) is derived from at least the third signal component (RF); and (c) representing the multi-channel audio signal at least by a resulting encoded signal (T) derived from at least the second encoded signal (T), the first set of encoding parameters (P2) and the second set of encoding parameters (P1).

Parametric descriptions of audio signals have gained interest in recent years because it has been shown that transmitting quantized parameters that describe audio signals requires relative little transmission capacity. These quantized parameters are capable of being received and processed in decoders to regenerate audio signals perceptually not significantly differing from their corresponding original audio signals.

Contemporary multi-channel encoders generate output encoded data at a bit rate that scales substantially linearly with a number of audio channels conveyed in the output encoded data. Such a characteristic renders inclusion of additional channels problematic because playing duration for a given data carrier storage capacity or quality of audio representation would have to be accordingly sacrificed to accommodate more channels.

SUMMARY OF THE INVENTION

An object of the present invention is to provide for a multi-channel encoder which is operable to provide more efficient encoding of multi-channel data content, for example multi-channel audio data content.

The inventors have appreciated that, by use of appropriate encoding methods, output encoded data is capable of conveying information corresponding to, for example, five-channel audio program content, whilst using a bit rate conventionally required to convey two-channel audio program content, namely stereo.

Thus, according to a first aspect of the present invention, there is provided a multi-channel encoder arranged to process input signals conveyed in N input channels to generate corresponding output signals conveyed in M output channels together with parametric data such that M and N are integers and N is greater than M, the encoder including:

(a) a down-mixer for down-mixing the input signals to generate corresponding output signals; and (b) an analyzer for processing the input signals either during down-mixing or as a separate process, said analyzer being operable to generate said parametric data complementary to the output signals, said parametric data describing mutual differences between the N channels of input signal so as to allow substantially for regenerating during decoding of one or more of the N channels of input signal from the M channels of output signal, said output signals being in a form compatible for reproduction in decoders providing for N or for fewer than N output channels to enable backwards compatibility.

The invention is of advantage in that the multi-channel encoder is capable of more efficiently encoding multi-channel input signals into an output stream which, for example, can be rendered to be compatible with two-channel stereo playback apparatus.

Such backwards compatibility of the encoder with earlier types of corresponding decoder is provided in three ways:

(a) the output down-mixed signals from the encoder are generated in such a way that playback of these signals, namely without additional processing or decoding, results in a spatial image which is a good approximation of, for example, a 5-channel spatial image, given the limitations of a corresponding limited number of loudspeakers. This property assures backward playback compatibility;

(b) spatial parameters associated with the down-mixed signals are placed in the ancillary data portion of the bit stream. A decoder which is not able to decode the ancillary data portion will still be able to decode the transmitted signal. This property assures backward decoding compatibility; and (c) parameters stored in the ancillary part of the bit-stream and the decoder structure are formulated in such a way that a parametric decoder is able to regenerate appropriate 2-, 3- and 4-channel signals. This property provides flexibility in terms of playback system utilized, and hence provides backwards compatibility with 2-, 3- and 4-channel systems.

Preferably, in the encoder, the analyzer includes processing means for converting the input signals by way of transformation from a temporal domain to a frequency domain and for processing these transformed input signals to generate the parametric data. Processing of the input signals in a frequency domain is of benefit in providing efficient encoding within the encoder. More preferably, in the encoder, at least one of the down-mixer and analyzer are arranged to process the input signals as a sequence of time-frequency tiles to generate the output signals.

Preferably, in the encoder, the tiles are obtained by transformation of mutually overlapping analysis windows. Such overlapping allows for better continuity and thereby reducing encoding artefacts when the output signals are subsequently decoded to regenerate a representation of the input signals.

Preferably, the encoder includes a coder for processing the input signals to generate M intermediate audio data channels for inclusion in the M output signals, the analyzer being arranged to output information in the parametric data relating to at least one of:

(a) inter-channel input signal power ratios or logarithmic level differences (b) inter-channel coherence between the input signals;

(c) a power ratio between the input signals of one or more channels and a sum of powers of the input signals of one or more channels; and (d) phase differences or time differences between signal pairs.

More preferably, the phase differences in (d) are average phase differences.

Preferably, in the encoder, calculation of at least one of the phase differences, the coherence data and the power ratio is followed by principal component analysis (PCA) and/or inter-channel phase alignment to generate the output signals.

Preferably, to provide a closer resemblance to the original input signals when the input data is regenerated, in the encoder, at least one of the input signals conveyed in the N channels corresponds to an effects channel.

Preferably, the encoder is adapted to generate the output signals in a form suitable for playback using conventional playback systems.

According to a second aspect of the invention, there is provided a method of encoding input signals conveyed in N input channels in a multi-channel encoder to generate corresponding output signals conveyed in M output channels together with parametric data such that M and N are integers and N is greater than M, the method including steps of:

(a) down-mixing the input signals to generate the corresponding output signals; and (b) processing in an analyzer the input signals either when being down-mixed or separately, said processing providing said parametric data complementary to the output signals, said parametric data describing mutual differences between the N channels of input data so as to allow substantially for regeneration of the N channels of input signal from the M channels of output signal during decoding, said output signals being in a form compatible for reproduction in decoders providing for N or for fewer than N output channels.

Preferably, the method is adapted to encode input signals corresponding to 5-channel and generate the output signals and parametric data in a form compatible with one or more of corresponding 2-channel stereo decoders, 3 channel decoders and 4-channel decoders.

Preferably, in the method, the processing includes converting the input signals by way of transformation from a temporal domain to a frequency domain.

Preferably, in the method, at least one of the input signals is processed as a sequence of time-frequency tiles to generate the output signals.

Preferably, in the method, the tiles correspond to mutually overlapping analysis windows.

Preferably, the method includes a step of using a coder for processing the input signals to generate M intermediate audio data channels for inclusion in the output signals, the coder being arranged to output information in the parametric data relating to at least one of:

(a) inter-channel input signal power ratios or logarithmic level differences;

(b) inter-channel coherence between the input signals;

(c) a power ratio between the input signals of one or more channels and a sum of powers of the input signals of one or more channels; and (d) phase differences or time differences between signal pairs.

More preferably, the phase differences in (d) are average phase differences.

Preferably, in the method, calculation of at least one of the level differences, the coherence data and the power ratio is followed by principal component analysis and/or phase alignment to generate the output signals.

Preferably, in the method, at least one of the input signals conveyed in the N channels corresponds to an effects channel.

According to a third aspect of the invention, there is provided encoded data content stored on a data carrier, said data content being generated using the method according to the second aspect of the invention.

According to a fourth aspect of the invention, there is provided a decoder operable to decode encoded output data as generated by an encoder according to the first aspect of the invention, said encoded output data comprising M channels and associated parametric data generated from input signals of N channels such that M<N where M and N are integers, the decoder including a processor:

(a) for receiving the encoded output data and converting it from a time domain to a frequency domain;

(b) for applying the parametric data in the frequency domain to extract content from the M channels to regenerate from the M channels regenerated data content corresponding to input signals of one or more of N channels not directly included in or omitted from the encoded output data; and (c) for processing the regenerated data content for outputting one or more of the regenerated input signals of N channels at one or more outputs of the decoder.

Preferably, in the decoder, the processor is operable to apply an all-pass decorrelation filter to obtain decorrelated versions of signals for use in regenerating said one or more input signals of N channels at the decoder.

Preferably, in the decoder, the processor is operable to apply inverse encoder rotation to split signals of the M channels and decorrelated versions thereof into their constituent components for regenerating said one or more input signals of N channels at the decoder.

It will be appreciated that features of the invention are susceptible to being combined in any combination without departing from the scope of the invention.

DESCRIPTION OF THE DIAGRAMS

Embodiments of the invention will now be described, by way of example only, with reference to the following diagrams wherein.

DESCRIPTION OF EMBODIMENTS OF THE INVENTION

Figure 1:
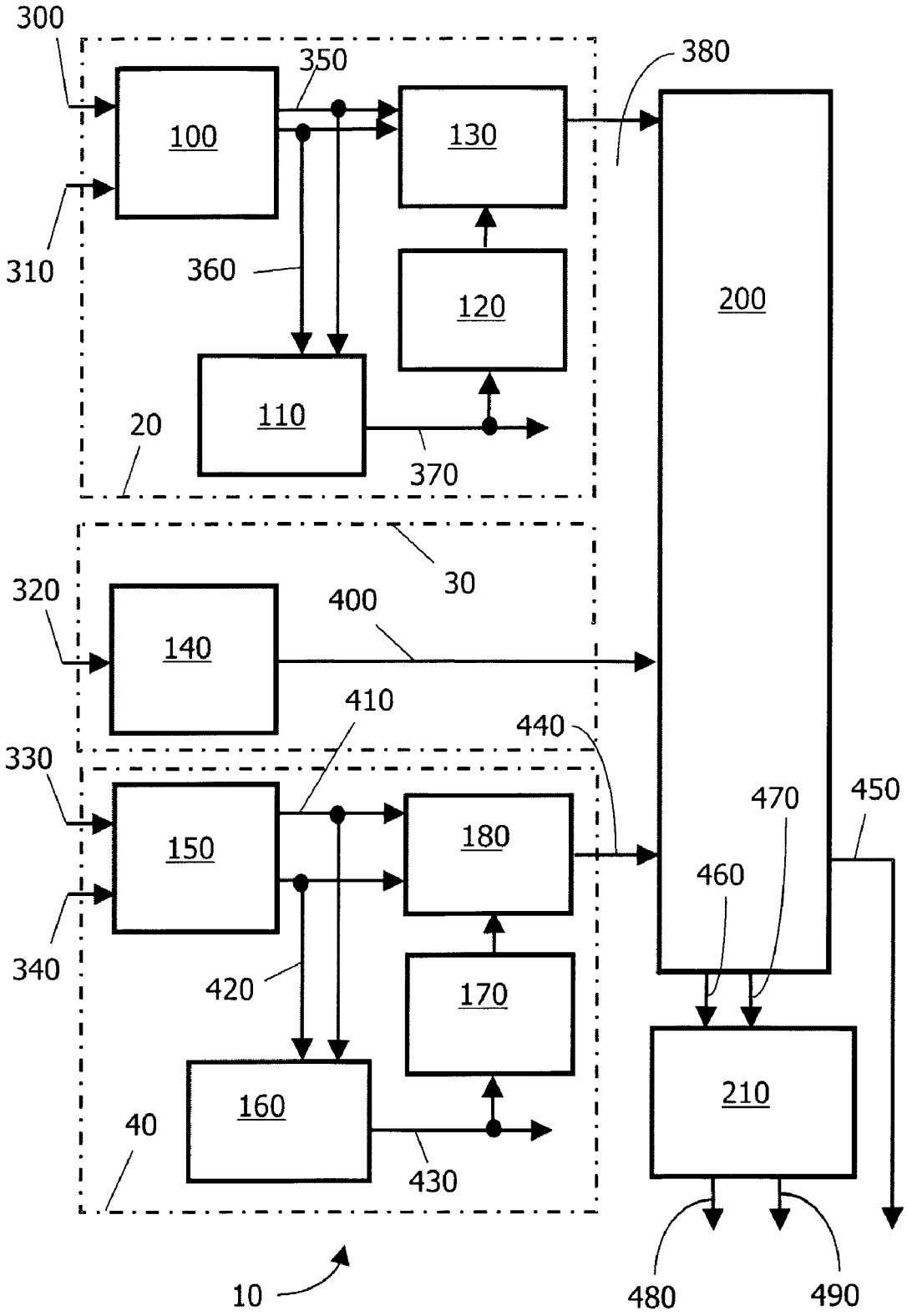
FIG. 1 is a schematic diagram of a first multi-channel encoder according to the invention.

In order to improve encoding executed within a multi-channel encoder provided with N channels of input data and arranged to encode the input data to generate a corresponding encoded output data stream, the inventors have envisaged that the encoder is beneficially operable:

(a) to down-mix the input data of the N channels into M channels such that M<N; and (b) to generate a relatively small amount of parametric overhead data to combine with data of the M channels when generating the output data stream, the parametric data being arranged to enable reconstruction of data corresponding to the N channels at a subsequent decoder supplied with the output data stream.

For example, the multi-channel encoder is preferably a five-channel encoder, namely N=5. The five-channel encoder is configured to down-mix data corresponding to five input channels to generate two channels of intermediate data, namely M=2. Moreover, the five-channel encoder is operable to generate associated parametric overhead data to combine with data of the two channels to generate the output data stream, the parametric data being sufficient to enable the decoder to reconstruct a representation of the five input channels. The decoder is of benefit in that it is capable of being backwards compatible to support situations where N=2, 3, 4, namely backwards compatible with 2-channel, 3-channel and 4-channel output situations.

In a preferred embodiment of the invention, an encoder is operable to process N input data channels. The N input channels preferably correspond to a center audio data channel, a left-front audio data channel, a left-rear audio data channel, a right-front audio data channel and a right rear audio data channel; such five channels are capable of creating an apparent 3-dimensional distribution of sound appropriate for domestic cinema-type program content reproduction. The N input data channels are down-mixed into two intermediate audio data channels, for example encoded using a contemporary stereo audio coder. The coder beneficially employs principal component analysis and/or phase alignment of the left-front and the left-rear data channels. The encoder is also arranged to employ a separate principal component analysis and/or phase alignment on the right-front and the right-rear input channels. Moreover, the encoder is operable to generate parametric overhead data including information relating to the following:

(a) inter-channel level differences between the left-front and left-rear data channels;

(b) inter-channel level differences between the right-front and right-rear data channels;

(c) inter-channel coherence data relating to the left-front and left-rear channels;

(d) inter-channel coherence data relating to the right-front and right-rear data channels; and (e) a power ratio between the center data channel and a sum of powers of the left-front, left-rear, right-front and right rear data channels.

The two intermediate data channels and the parametric overhead data are combined to generate encoded output data from the encoder. Optionally, data relating to inter-channel phase differences and preferably overall phase differences between the left-front and left-rear data channels on the one hand, and right-front and right-rear data channels on the other hand are included in the encoded output data from the encoder. Parametric analysis performed in (a) to (e) with regard to this example embodiment of the invention preferably involves temporal and frequency analysis; more preferably, the analysis is performed by way of time-frequency tiles as will be further elucidated later.

Operation of the encoder in the preferred embodiment of the invention will now be described in greater detail in terms of its associated mathematical functions with reference to FIG. 1 whose parts and signals are defined as provided in Table 1.

TABLE 1

| | |
|---|---|
| 10 | Encoder |
| 20 | First channel |
| 30 | Second channel |
| 40 | Third channel |
| 100 | Segment and transform unit |
| 110 | Parameter analysis unit |
| 120 | Parameter-to-down-mix vector unit |
| 130 | Down-mix unit |
| 140 | Segment and transform unit |
| 150 | Segment and transform unit |
| 160 | Parameter analysis unit |
| 170 | Parameter-to-down-mix vector unit |
| 180 | Down-mix unit |
| 200 | Mixing and parameter extraction unit |
| 210 | Inverse transform and OLA unit |
| 300 | Left front input signal, $S_{lf}$ |
| 310 | Left rear input signal, $S_{lr}$ |
| 320 | Centre signal, $S_c$ |
| 330 | Right front signal, $S_{rf}$ |
| 340 | Right rear signal, $S_{rr}$ |
| 350 | Left front transformed signal, $TS_{lf}$ |
| 360 | Left rear transformed signal, $TS_{lr}$ |
| 370 | First parameter set, PS1 |
| 380 | Left intermediate signal, LI |
| 400 | Centre intermediate signal, CI |
| 410 | Right front transformed signal, $TS_{rf}$ |
| 420 | Right rear transformed signal, $TS_{rr}$ |
| 430 | Second parameter set, PS2 |
| 440 | Right intermediate signal, RI |
| 450 | Third parameter set, PS3 |
| 460 | Right pre-output signal, $PR_{out}$ |
| 470 | Left pre-output signal, $PL_{out}$ |
| 480 | Right output signal, $R_{out}$ |
| 490 | Left output signal, $L_{out}$ |

In FIG. 1, there is shown an encoder indicated generally by 10. The encoder 10 comprises first, second and third input channels 20, 30, 40 respectively. Output signals 380, 400, 440, namely LI, CI, RI, from these three channels 20, 30, 40 respectively are coupled to a mixing and parameter extraction unit 200. The extraction unit 200 comprises associated right and left pre-output signals 460, 470, namely $PR_{out}$, $PL_{out}$, which are connected to an inverse transform and OLA unit 210 for generating encoded right and left output signals 480, 490, namely $R_{out}$, $L_{out}$ respectively.

The first channel 20 includes a segment and transform unit 100 for receiving left front and left rear input signals 300, 310 respectively, namely $S_{lf}$, $S_{lr}$. Corresponding left front and left rear transformed signals 350, 360, namely $TS_{lf}$, $TS_{lr}$, are coupled to a down-mix unit 130 of the channel 20, and also to parameter analysis unit 110 of the channel 20. A first parameter set signal 370, namely PS1, is coupled to an input of the parameter-to-down-mix vector conversion unit 120 whose corresponding output is coupled to the down-mix unit 130.

The second channel 30 includes a segment and transform unit 140 arranged to receive a center input signal 320, namely $S_c$. The center intermediate signal 400, namely CI, is coupled from the transform unit 140 to the parameter extraction unit 200 as described in the foregoing.

The third channel 40 includes a segment and transform unit 150 for receiving right front and right rear input signals 330, 340 respectively, namely $S_{rf}$, $S_{rr}$. Corresponding right front and right rear transformed signals 410, 420, namely $TS_{rf}$, $TS_{rr}$, are coupled to a down-mix unit 180 of the channel 40, and also to parameter analysis unit 160 of the channel 40. A second parameter set signal 430, namely PS2, is coupled to an input of the parameter-to-down-mix vector conversion unit 170 whose corresponding output is coupled to the down-mix unit 180.

The Parameter extraction unit 200 is arranged to receive signal 380, 400, 440 from the channels 20, 30, 40 to generate the third parameter set output 450, namely PS3, as well as the pre-output signals 470, 460, namely $PR_{out}$, $PL_{out}$ for the OLA unit 210.

The encoder 10 is susceptible to being implemented in dedicated hardware. Alternatively, the encoder 10 can be based on computer hardware arranged to execute software for implementing processing functions of the encoder 10. As a further alternative, the encoder 10 can be implemented by a combination of dedicated hardware coupled to computer hardware operating under software control.

Operation of the encoder 10 will now be described with reference to FIG. 1. The signals $S_{lf}[n]$, $S_{lr}[n]$, $S_{rf}[n]$, $S_{rr}[n]$, $S_c[n]$ describe discrete temporal waveforms for left-front, left-rear, right-front, right-rear and centre audio signals respectively. In the channels 20, 30, 40, these five signals are segmented using a common segmentation, preferably using overlapping analysis windows. Subsequently, each segment is converted from a temporal domain to a frequency domain using a complex transform, for example a Fourier transform or equivalent type of transform; alternatively, complex filter-bank structures, for example implemented using at least one of hardware or simulated in software, may be employed to obtain time/frequency tiles. Such signal processing results in segmented sub-band representations of the input signals in frequency domain denoted by $L_f[k]$, $L_r[k]$, $R_f[k]$, $R_r[k]$, $C[k]$ wherein a parameter k denotes a frequency index, L denotes left, R denotes right, f denotes front, r denotes rear and C denotes center.

In the parameter extraction unit 200, data processing is executed in a first step to estimate relevant parameters between left-front and left-rear signals. These parameters include a level difference $IID_L$, a phase difference $IPD_L$ and a coherence $ICC_L$. Preferably, the phase difference $IPD_L$ corresponds to an average phase difference. Moreover, these parameters $IID_L$, $IPD_L$ and $ICC_L$ are calculated as provided in Equations 1 to 3 (Eq. 1 to 3):

$$IID_L = 10\log10\left(\frac{\sum_k L_f[k]L_f^*[k]}{\sum_k L_r[k]L_r^*[k]}\right) \quad \text{Eq. 1}$$

$$IPD_L = \angle\left(\frac{\sum_k L_f[k]L_r^*[k]}{\sqrt{\sum_k L_f[k]L_f^*[k]\sum_k L_r[k]L_r^*[k]}}\right) \quad \text{Eq. 2}$$

$$ICC_L = \left|\left(\frac{\sum_k L_f[k]L_r^*[k]}{\sqrt{\sum_k L_f[k]L_f^*[k]\sum_k L_r[k]L_r^*[k]}}\right)\right| \quad \text{Eq. 3}$$

wherein a symbol * denotes a complex conjugate.

The processes described by Equations 1 to 3 is also repeated for right-front and right-rear signals, such processing resulting in corresponding parameters $IID_R$, $IPD_R$ and $ICC_R$ relating to level difference, phase difference and coherence respectively.

In the parameter-to-down-mix vector conversion unit 120, data processing is executed in a second step to compute complex weights for the down-mix of the two signals left-front $L_f$ and left-rear $L_r$. In the preferred embodiment, the down-mix vector sent to the down-mix unit 130 is arranged to maximize the energy of the down-mix signal Y[k] by applying a rotation α of the input signal space and/or complex phase alignment.

The down-mix is applied as follows. The two signals $L_f$ and $L_r$ are rotated to obtain a dominant signal Y[k] and a corresponding residual signal Q[k] using a rotation angle α which maximizes the energy of the dominant signal Y[k] as depicted by Equation 4 (Eq. 4):

$$\begin{bmatrix} Y[k] \\ Q[k] \end{bmatrix} = \begin{bmatrix} \cos\alpha & \sin\alpha \\ -\sin\alpha & \cos\alpha \end{bmatrix} \begin{bmatrix} L_f[k]\cdot\exp(j(-OPD_L)) \\ L_r[k]\cdot\exp(j(-OPD_L + IPD_L)) \end{bmatrix} \quad \text{Eq. 4}$$

wherein an angle $OPD_L$ denotes an overall phase rotation angle, whilst the phase difference $IPD_L$ is calculated to ensure a maximum phase-alignment of the two signals $L_f$, $L_r$. The rotation angle α is calculable from the extracted parameters using Equations 5 and 6 (Eq. 5 and 6):

$$\alpha = \frac{1}{2}\arctan\left(\frac{2gICC_L}{g^2 - 1}\right) \quad \text{Eq. 5}$$

$$\text{wherein } g = 10^{\frac{IID_L}{20}} \quad \text{Eq. 6}$$

The signal Q[k] from Equation 4 is subsequently discarded in the parameter extraction unit 200, the signal Y[k] is scaled by a scalar β to obtain the signal L[k] in such a way that the signal L[k] has a similar power to that of the signal Q[k] plus the power of the signal Y[k]; in other words, the signal Q[k] is discarded whilst a corresponding loss in signal power arising is compensated by scaling the signal Y[k]. The scalar β is calculable using Equations 7 and 8 (Eq. 7 and 8):

$$\beta = \sqrt{1 + \frac{1 - \sqrt{\mu}}{1 + \sqrt{\mu}}} \quad \text{Eq. 7}$$

wherein $$\mu = 1 + \frac{4ICC_L^2 - 4}{\left(g + \frac{1}{g}\right)^2} \quad \text{Eq. 8}$$

The first and second steps are also repeated for the right-front and right-rear signal pairs, resulting in generation of the corresponding signal R[k]. It is to be noted that the use of PCA rotation can be circumvented by using a fixed value for the rotation angle α.

A third processing step executed within the encoder 10 involves mixing the center signal C[k] into both of the signals L[k] and R[k] resulting in generation of the pre-output signals 470, 460 respectively, namely $PL_{out}$, $PR_{out}$. Such mixing is executed according to Equation 9 (Eq. 9):

$$\begin{bmatrix} PL_{out}[k] \\ PR_{out}[k] \end{bmatrix} = \begin{bmatrix} L[k] + \varepsilon C[k] \\ R[k] + \varepsilon C[k] \end{bmatrix} \quad \text{Eq. 9}$$

wherein a parameter ϵ denotes a weight determining the strength of the signal C[k] in mixing associated with Equation 9, for example ϵ=0.707 typically. Preferably, respective combinations of L, C and R are aligned in terms of phase, otherwise phase cancellation would occur.

A parameter $IID_C$ describing the power of signal C with respect to the power of signals L and R is calculable from Equation 10 (Eq. 10):

$$IID_C = 10\log10\left(\frac{\varepsilon^2 \sum_k C[k]C^*[k]}{\sum_k L[k]L^*[k] + \sum_k R[k]R^*[k]}\right) \quad \text{Eq. 10}$$

The foregoing process comprising the aforementioned first, second and third steps is repeated in the encoder 10 for each time/frequency tile.

The signals $PL_{out}$[k] and $PR_{out}$[k] are subsequently transformed in the encoder to a temporal domain and combined with previous segments using an overlap-add type of summation to generate the aforesaid output signals 490, 480 respectively, namely $L_{out}$, $R_{out}$.

Output data from the encoder 10 is susceptible to being communicated by way of a communication network, for example via the Internet or other similar broadcast network. Alternatively, or additionally, the output data is capable of being conveyed by way of a data carrier, for example a DVD optical data disk or other similar type of data carrying medium.

Figure 3:
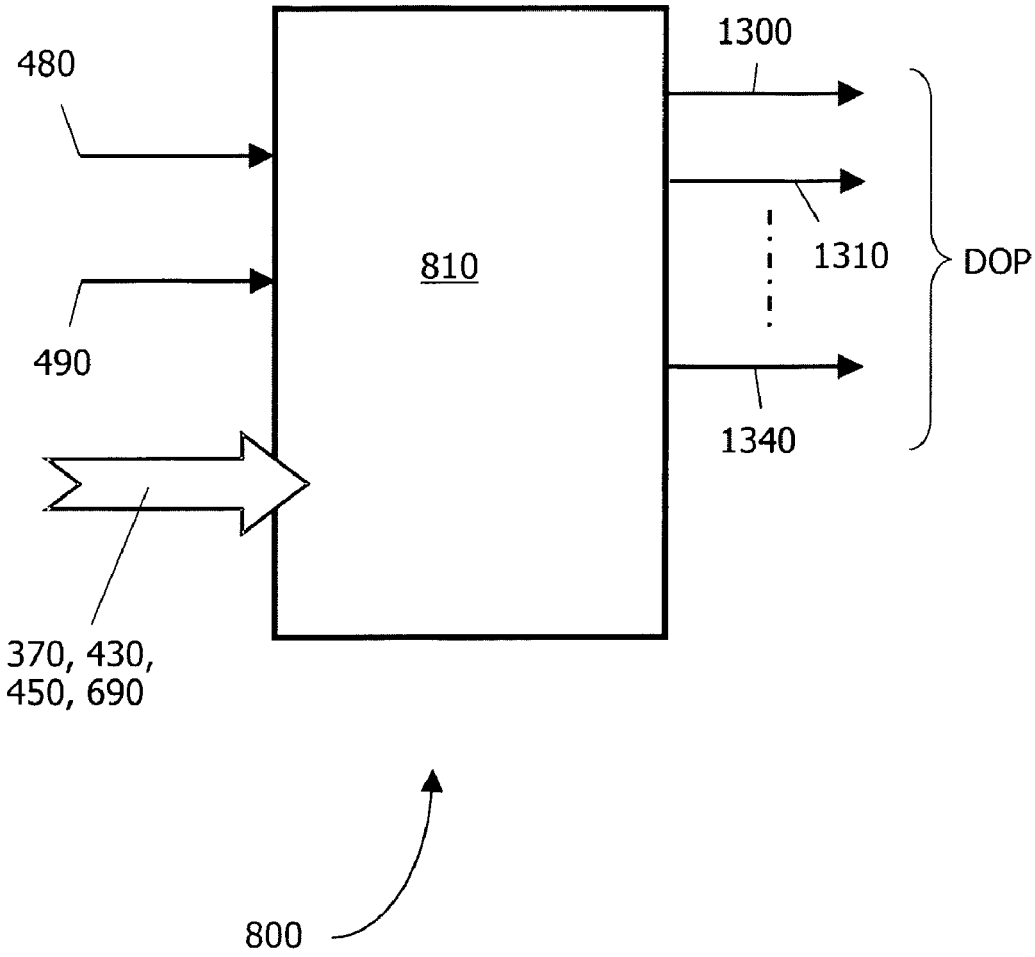
FIG. 3 is a schematic diagram of a multi-channel decoder according to the invention, the decoder being complementary to the encoders of FIGS. 1 and 2 and capable of decoding output data provided from such encoders.

The output data from the encoder 10 is capable of being decoded in decoders compatible with the encoder 10, for example in a decoder indicated generally by 800 in FIG. 3. The decoder 800 includes a data processing unit 810 for subjecting output signals 480, 490 and associated parameter data 370, 430, 450, 690 received from the encoders 10, 600 to various mathematical operations to generate corresponding decoded output signals (DOP).

In order to provide backwards compatibility, such decoders can be at least one of stereo, 3-channel and 5-channel apparatus. In a stereo-type decoder compatible with the encoder 10, namely where decoder 800 includes only two decoded outputs for DOP, the stereo-type decoder having two playback channels, the signals $R_{out}$, $L_{out}$ provided from the encoder 10 are reproduced in the stereo-type decoder over two playback channels without further processing being performed.

In a 3-channel decoder compatible with the encoder 10, the decoder having three playback channels, namely where the decoder 800 includes three decoded outputs for DOP, the two signals Rout, Lout, for example read from a data carrier such as a DVD optical disk, are segmented and then transformed to the aforementioned frequency domain. Corresponding recreated signals L[k], R[k] and C[k] are then derived using Equations 11 to 16 (Eq. 11 to 16)

$$\begin{bmatrix} L[k] \\ R[k] \\ C[k] \end{bmatrix} = \begin{bmatrix} w_L L_{out} \\ w_R R_{out} \\ w_{LC} L_{out} + w_{RC} R_{out} \end{bmatrix} \quad \text{Eq. 11}$$

wherein $$w_{LC} = \frac{0.5}{\varepsilon}\sqrt{\frac{\sigma_C^2}{\sigma_L^2}} \quad \text{Eq. 12}$$

$$w_{RC} = \frac{0.5}{\varepsilon}\sqrt{\frac{\sigma_C^2}{\sigma_R^2}} \quad \text{Eq. 13}$$

$$\sigma_L^2 = \sum_k L_{out}[k]L_{out}^*[k] \quad \text{Eq. 14}$$

$$\sigma_R^2 = \sum_k R_{out}[k]R_{out}^*[k] \quad \text{Eq. 15}$$

$$\sigma_C^2 = \frac{\sigma_L^2 + \sigma_R^2}{2 + 10^{\frac{-IID_C}{10}}}. \quad \text{Eq. 16}$$

Three-channel audio signals for user-appreciation are then derived from the signals L[k], R[k] and C[k] in a manner similar to that described in the foregoing.

In a five-channel decoder compatible with the encoder 10, namely the decoder 800 providing five decoded outputs, a three-channel playback reconstruction as described in the foregoing is employed resulting in regeneration of the signals L[k], R[k] and C[k] at the decoder. In the five-channel decoder, a further step is executed which involves splitting the signal L[k] in its constituent components, namely a front left component $L_f[k]$ and a rear left component $L_r[k]$; similarly, the signal R[k] is also split into its constituent components, namely a front right component $R_f[k]$ and a rear right component $R_r[k]$. Such signal splitting utilizes an inverse encoder rotation operation complementary to the rotation performed in the encoder 10 as described in the foregoing. The dominant signal Y[k] and the residual signal Q[k] required for the inverse rotation are derived in the five-way decoder using Equations 17 and 18 (Eq. 17, 18):

$$\begin{bmatrix} Y[k] \\ Q[k] \end{bmatrix} = \begin{bmatrix} L[k]\cos\gamma \\ H[k]L[k]\sin\gamma \end{bmatrix} \quad \text{Eq. 17}$$

wherein $$\gamma = \arctan\left(\frac{1-\sqrt{\mu}}{1+\sqrt{\mu}}\right) \quad \text{Eq. 18}$$

for which the parameter t is previous defined in Equation 8 (Eq. 8) in the foregoing. In Equation 17, H[k] denotes an all-pass decorrelation filter to obtain a decorrelated version of the signal L[k]. Subsequently, the signals $L_f[k]$ and $L_r[k]$ are generated using an inverse encoder rotation function as described by Equation 19 (Eq. 19):

$$\begin{bmatrix} L_f[k] \\ L_r[k] \end{bmatrix} = \begin{bmatrix} \cos\alpha & -\sin\alpha \\ \sin\alpha & \cos\alpha \end{bmatrix} \begin{bmatrix} \exp(jOPD_L) & 0 \\ 0 & \exp(jOPD_L - IPD_L) \end{bmatrix} \begin{bmatrix} Y[k] \\ Q[k] \end{bmatrix} \quad \text{Eq. 19}$$

Similar processing is also applied for right hand channel components.

In a four-channel decoder compatible with the encoder 10, the four-channel decoder is operable to firstly decode five channels in a manner akin to that employed in the aforementioned five-channel decoder to generate five audio signals $S_{lf}$, $S_{lr}$, $S_{rf}$, $S_{rr}$ and $S_c$. Thereafter, simple mixing occurs according to Equations 20 and 21 (Eq. 20, 21) to generate left-front and right-front audio signals $S_{lf,playback}$, $S_{rf,playback}$ for user appreciation:

$$S_{lf,playback} = S_{lf} + qS_c \quad \text{Eq.20}$$

$$S_{rr,playback} = S_{rf} + qS_c \quad \text{Eq.21}$$

wherein a coefficient q=0.707.

The coefficient q ensures for the four-channel decoder that the total power of the center signal components is substantially constant, irrespective of playback through a single center loudspeaker or as a phantom apparent source of sound for the user created by left front and right front loudspeakers coupled to the four-channel decoder.

It will be appreciated that embodiments of the invention described in the foregoing are susceptible to being modified without departing from the scope of the invention as defined by the accompanying claims.

Figure 2:
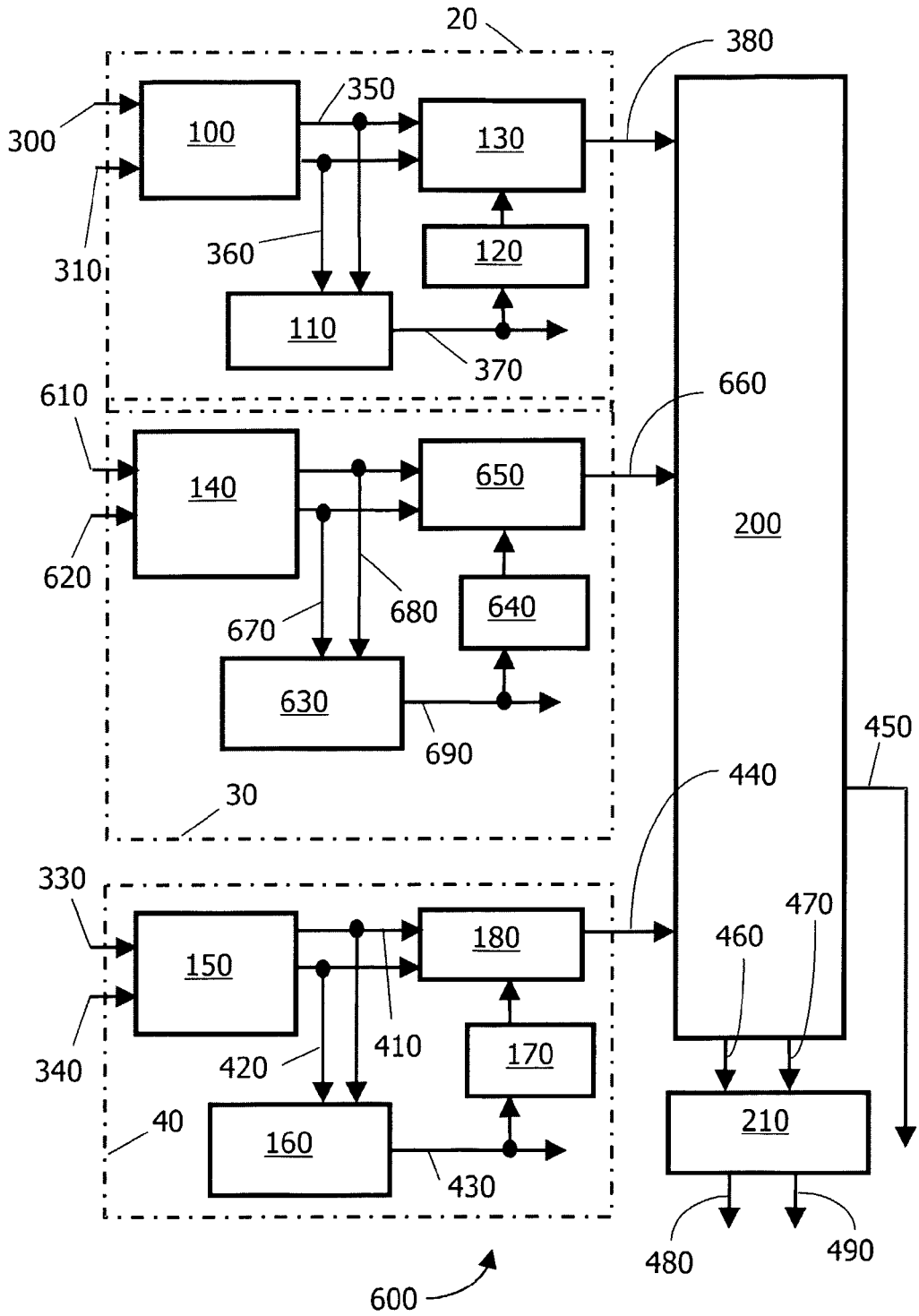
FIG. 2 is a schematic diagram of a second multi-channel encoder according to the invention including provision for effects, for example low-frequency effects.

The inventors have identified that the encoder 10 does not support coding of an effects channel (LFE), for example a low frequency effects channel. Such a LFE channel is of benefit, for example, for conveying sound effects information such as thunder-sound information or explosion sound information which beneficially accompanies visual information simultaneously presented to users in, for example, a home movie system. Thus, the inventors have appreciated in an embodiment of the present invention that it is beneficial to modify the encoder 10 to enhance its second channel 30 and thereby generate an encoder as depicted in FIG. 2 and indicated therein generally by 600. Optionally, the LFE channel has a relatively restricted frequency bandwidth of substantially 120 Hz although selective relatively greater bandwidths are also capable of being accommodated.

The encoder 600 is generally similar to the encoder 10 except that the second channel 30 of the encoder 600 is furnished with a parameter analysis unit 630, a parameter to down-mix vector unit 640 and a down-mix unit 650 connected in a similar manner to corresponding components of the first and third channels 20, 40 respectively; the channel 30 of the encoder 600 is operable to output a fourth parameter set 690, namely PS4. Moreover, the second channel 30 of the encoder 600 includes a low frequency effects (lfe) input 610 for receiving a low frequency effects signal $S_{lfe}$, and also an input 620 for receiving the aforementioned center signal $S_C$. Preferably, processing of the signal $S_{lfe}$ is limited to a frequency bandwidth of 120 Hz from sub-audio frequencies upwards and therefore potentially suitable for driving contemporary sub-woofer type loudspeakers. However, embodiments of the invention are susceptible to being implemented with the second channel 30 having a much greater bandwidth than 120 Hz, for example to provide high frequency signal information corresponding to impulse-like sounds.

Inclusion of low frequency effect information in output from the encoder 600 requires use of additional parameters in comparison to the encoder 10. A signal presented to the input 610 is analyzed in the encoder 600 to determine corresponding representative parameters which are analyzed on a time/frequency tile basis in a similar manner to other aforementioned audio signals processed through the encoder 10. Corresponding decoders are preferably arranged to include additional features for decoding the low frequency information to regenerate, for example, a signal suitable for amplification to drive audio sub-woofer loudspeakers in home movie systems.

In the accompanying claims, numerals and other symbols included within brackets are included to assist understanding of the claims and are not intended to limit the scope of the claims in any way.

Expressions such as "comprise", "include", "incorporate", "contain", "is" and "have" are to be construed in a non-exclusive manner when interpreting the description and its associated claims, namely construed to allow for other items or components which are not explicitly defined also to be present. Reference to the singular is also to be construed to be a reference to the plural and vice versa.

The invention claimed is:

1. A multi-channel encoder arranged to process input signals conveyed in N input channels to generate corresponding output signals conveyed in M output channels together with parametric data, wherein M and N are integers and N is greater than M, the encoder comprising:

(a) a down-mixer for down-mixing the input signals to generate corresponding output signals; and (b) an analyzer for processing the input signals either during down-mixing or as a separate process, said analyzer being operable to generate said parametric data complementary to the output signals, said parametric data describing mutual differences between the N channels of input signals, so as to allow substantially for regenerating during decoding of one or more of the N channels of input signals from the M channels of output signals, said output signals being in a form compatible for reproduction in decoders providing for N or for fewer than N output channels to enable backwards compatibility, characterized in that the parametric data comprises at least one parameter describing a power of a central channel signal with respect to a power of a right channel signal and a left channel signal for a two channel downmix of the central channel signal, the right channel signal and the left channel signal, the at least one parameter being substantially given by:

$$IID_C = 10\log10\left(\frac{\varepsilon^2\sum_k C[k]C^*[k]}{\sum_k L[k]L^*[k] + \sum_k R[k]R^*[k]}\right)$$

where C[k] denotes sample k of the central channel signal C; R[k] denotes sample k of the right signal R, L[k] denotes sample k of the left signal C and $\epsilon$ denotes a weight determining a strength of the central signal in the two channel downmix.

2. The multi-channel encoder as claimed in claim 1, wherein the multi-channel encoder is a 5-channel encoder arranged to generate the output signals and parametric data in a form compatible with at least one of corresponding 2-channel stereo decoders, 3 channel decoders and 4-channel decoders.

3. The multi-channel encoder as claimed in claim 1, wherein the analyzer includes processing means for converting the input signals by way of transformation from a temporal domain to a frequency domain and for processing these transformed input signals to generate the parametric data.

4. The multi-channel encoder as claimed in claim 3, wherein at least one of the down-mixer and the analyzer are arranged to process the input signals as a sequence of time-frequency tiles to generate the output signals.

5. The multi-channel encoder as claimed in claim 4, wherein the tiles are obtained by transformation of mutually overlapping analysis windows.

6. The multi-channel encoder as claimed in claim 1, wherein said multi-channel encoder further includes a coder for processing the input signals to generate M intermediate audio data channels for inclusion in the M channels of output signals, the analyzer further being arranged to output information in the parametric data relating to at least one of:

(a) inter-channel input signal power ratios or logarithmic level differences;

(b) inter-channel coherence between the input signals;

(c) a power ratio between the input signals of one or more channels and a sum of powers of the input signals of one or more channels; and (d) phase differences or time differences between signal pairs.

7. The multi-channel encoder as claimed in claim 6, wherein in (d) said phase differences are average phase differences.

8. The multi-channel encoder as claimed in claim 6, wherein calculation of at least one of the phase differences, coherence data and the power ratios is followed by principal component analysis (PCA) and/or inter-channel phase alignment to generate the N output channels.

9. The multi-channel encoder as claimed in claim 1, wherein at least one of the input signals conveyed in the N channels corresponds to an effects channel.

10. The multi-channel encoder as claimed in claim 1, wherein said multi-channel encoder is adapted to generate the output signals in a form suitable for playback using conventional playback systems.

11. A method of encoding input signals conveyed in N input channels in a multi-channel encoder to generate corresponding output signals conveyed in M output channels together with parametric data, wherein M and N are integers and n is greater than M, the method comprising the steps of:

a ) down-mixing input signals to generate the corresponding output signals; and (b) processing an analyzer the input signals when being down-mixed or separately, said processing providing said parametric data complementary to the output signals, said parametric data describing mutual differences between the N channels of input signal so as to allow substantially for regeneration of the N channels of input signals from the M channels of output signals during decoding, said output signals being in a form compatible for reproduction in decoders providing for N or for fewer than N channels, characterized in that the parametric data comprises at least one parameter describing a power of a central channel signal with respect to a power of a right channel signal and a left channel signal for a two channel downmix of the central channel signal, the right channel signal and the left channel signal; the at least one parameter being substantially given by:

$$IID_C = 10\log10\left(\frac{\varepsilon^2\sum_k C[k]C^*[k]}{\sum_k L[k]L^*[k] + \sum_k R[k]R^*[k]}\right)$$

where C[k] denotes sample k of the central channel signal C; R[k] denotes sample k of the right signal R, L[k] denotes sample k of the left signal C and $\epsilon$ denotes a weight determining a strength of the central signal in the two channel downmix.

12. The method of encoding as claimed in claim 11, wherein the multichannel encoding is adapted to encode input signals corresponding to 5-channels and generate the output signals and parametric data in a form compatible with one or more of corresponding 2-channel stereo decoders, 3-channel decoders and 4-channel decoders.

13. The method of encoding as claimed in claim 11, wherein said processing includes converting the input signals by way of transformation from a temporal domain to a frequency domain.

14. The method of encoding as claimed in claim 13, wherein at least one of the input signals are processed as a sequence of time-frequency tiles to generate the output signals.

15. The method of encoding as claimed in claim 14, wherein the tiles correspond to mutually overlapping analysis windows.

16. The method of encoding as claimed in claim 11, wherein said processing further includes using a coder for processing the input signals to generate H intermediate audio data channels for inclusion in the output signals, the coder further being arranged to output information in the parametric data relating to at least one of:

(a) inter-channel input power ratios or logarithmic level differences;

(b) inter-channel coherence between the input signals;

(c) a power ratio between the input signals of one or more channels and a sum of powers of the input signals of one or more channels; and (d) power differences or time differences between signal pairs.

17. The method of encoding as claimed in claim 16, wherein the power differences are average power differences.

18. The method of encoding as claimed in claim 16, wherein calculation of at least one of the phase difference, the coherence data and the power ratio is followed by principal component analysis (PCA) and/or inter-channel phase alignment to generate the output signals.

19. The method of encoding as claimed in claim 11, wherein at least one of the input signals conveyed in the N channels corresponds to an effects channel.

20. A computer-readable medium having stored thereon encoded data content generated using the method as claimed in claim 11.

21. A decoder operable to decode encoded output data as generated by an encoder, said encoded output data comprising M channels and associated parametric data generated from input signals of N channels, wherein M<N where M and N are integers, the decoder including a processor:

(a) for receiving the encoded output data converting the encoded output data from a time domain to a frequency domain;

(b) for applying the parametric data in the frequency domain to extract content from the M channels to regenerate from the M channels regenerated data content corresponding to input signals of one or more of N channels not directly included in or omitted from the encoded output data; and (c) for processing the regenerated data content for outputting one or more of the regenerated input signals of N channels at one or more outputs of the decoder, wherein the processor is arranged to generated a regenerated left channel L[k], a regenerated right channel R[k] and a regenerated center channel C[k] as $$\begin{bmatrix} L[k] \\ R[k] \\ C[k] \end{bmatrix} = \begin{bmatrix} w_L L_{out} \\ w_R R_{out} \\ w_{LC} L_{out} + w_{RC} R_{out} \end{bmatrix}$$

where $L_{out}$ is a left channel of the M channels, $R_{out}$ is a right channel of the M channels, and $w_{LC}$ and $w_{RC}$ depend on an interchannel level parameter of the parametric data.

22. The decoder as claimed in claim 21, wherein said processor is operable to apply an all-pass decorrelation filter to obtain decorrelated versions of signals for use in regenerating said one or more input signals of N channels at the decoder.

23. The decoder as claimed in claim 22, wherein the processor is operable to apply inverse encoder rotation to split signals of the M channels and decorrelated versions thereof into their constituent components for regenerating said one or more input signals of N channels at the decoder.

24. The decoder as claimed in claim 23, said decoder being operable to generate its one or more decoder outputs solely from said M channels of encoded output data received at the decoder.

* * * * *